United States Patent [19]

Jonsson

[11] Patent Number: 4,465,426

[45] Date of Patent: Aug. 14, 1984

[54] HANDLING EQUIPMENT FOR SHEET PRESSES

[75] Inventor: Finn Jonsson, Ystad, Sweden

[73] Assignee: ASEA Aktiebolag, Västerås, Sweden

[21] Appl. No.: 395,993

[22] Filed: Jul. 7, 1982

[30] Foreign Application Priority Data

Jul. 10, 1981 [SE] Sweden ..... 8104297

[51] Int. Cl.[3] ..... B65G 1/04

[52] U.S. Cl. ..... 414/751; 414/32; 414/82; 414/222; 271/4; 271/84; 271/267; 198/486

[58] Field of Search ..... 414/14, 32, 80, 82, 414/222, 749, 751; 271/194, 3-5, 267-269, 84, 85; 100/207; 198/486

[56] References Cited

U.S. PATENT DOCUMENTS 2,413,553 12/1946 Evers ..... 271/194 X
4,065,003 12/1977 Hostettler .
4,279,561 7/1981 Schneider et al. ..... 100/207 X
4,344,727 8/1982 Chaloupka ..... 414/80 X
4,407,630 10/1983 Toda ..... 100/207 X

FOREIGN PATENT DOCUMENTS 944234 6/1956 Fed. Rep. of Germany .

*Primary Examiner*—Robert J. Spar
*Assistant Examiner*—Terrance L. Siemens
*Attorney, Agent, or Firm*—Watson, Cole, Grindle & Watson

[57] ABSTRACT

Handling equipment for a sheet press for feeding sheet blanks to the press and withdrawing pressed products from the press, includes a first station for the reception of pressed products, a second station containing a supply of sheet blanks, a track extending from the press to the stations, and a shuttle movable along the track and having substantially horizontal, first and second transport compartments at different levels, the first compartment receiving sheet blanks from the second station for delivering them to the press, and the second compartment receiving pressed products from the press for delivering them to the first station.

3 Claims, 5 Drawing Figures

HANDLING EQUIPMENT FOR SHEET PRESSES

TECHNICAL FIELD

This invention relates to a handling equipment of the kind employed with a sheet press for feeding sheet blanks to the press and for withdrawing pressed products from the press. In particular it relates to such handling equipment which is intended for handling products having small press depth, such as sheets for plate heat exchangers and the like.

One object of the invention is to provide a handling equipment of the kind referred to for use with a rapidly working press for pressing large products from thin sheet material. The short pressing cycle time of such presses requires that the mass in the handling equipment should be small, in order that the forces required for driving the handling equipment are moderate and that the drive means for the handling equipment is of a moderate size. The invention therefore aims to provide a handling equipment of the kind referred to which has a small mass, and which is particularly suitable for handling large thin plates of small stiffness, which are especially difficult to handle.

DISCLOSURE OF THE INVENTION

According to the invention, handling equipment for a sheet press for feeding sheet blanks to the press and withdrawing pressed products from the press, comprises a first station for the reception of pressed products, a second station to contain a supply of sheet blanks, a track extending from the press to said stations, and a shuttle movable along said track and having substantially horizontal, first and second transport compartments at different levels, the first compartment serving to recieve sheet blanks from the second station and deliver them to the press, and the second compartment serving to receive pressed products from the press and deliver them to the first station.

In one embodiment of handling equipment in accordance with the invention, said shuttle is reciprocatable along the track, and the two horizontal transport compartments are superimposed one above the other. The track passes over the first and second stations and extends into the press. The shuttle may be driven back forth on the track by any suitable drive means, for example by pneumatic or hydraulic cylinders, between a first end position over the first station and a second end position in the press. At the end of the track where the first station is situated, there is a gripper which is operable to retain a pressed product present in the shuttle so that this product is withdrawn from the shuttle when the shuttle moves away from its first end position over the first station. The pressed product then falls down into the first station. At the second station there is a lifting device, at the end of the second station which is located farthest away from the press, for raising one end of a sheet blank to the same level as the first transport compartment of the shuttle. Upon movement of the shuttle towards the press, the sheet blank is inserted into the first transport compartment. At the end of the second station which is nearer to the press, there is a stop means which prevents the sheet blank from being displaced horizontally when the shuttle moves towards the press until the shuttle raises the sheet blank above the stop means. The press comprises a lifting device which, after a pressing operation, raises the end of the pressed product which faces the shuttle until it comes to the same level as the second transport compartment of the shuttle. Upon movement of the shuttle into the press, the pressed product is fed into the second transport compartment. The press also comprises a gripper which grips the sheet blank when the shuttle has reached its second end position in the press. This gripper retains the sheet blank during the first part of the return movement of the shuttle. When the shuttle leaves the press, the sheet blank falls down onto a layer press tool of the press.

BRIEF DESCRIPTION OF DRAWINGS

The invention will now be described in greater detail and by way of example, with reference to the accompanying drawings, in which.

DESCRIPTION OF PREFERRED EMBODIMENTS

Figure 2:
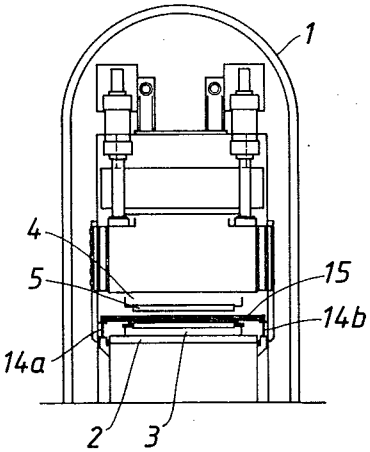
FIG. 2 is an end view corresponding to FIG. 1.

In the drawings, the numeral 1 designates a press having a lower, fixed press table 2 provided with a fixed press tool 3 and an upper, vertically movable press table 4 provided with a movable press tool 5. At one side of the press there is provided a handling equipment comprising a first station 6 for receiving products 11 which have been pressed in the press and a second station 7 for sheet blanks 10 which are to be pressed in the press 1 to form the products 11. These stations 6 and 7 contain cars 8 and 9, respectively, for the reception of finished products 11 and sheet blanks 10, respectively. The cars 8 and 9 are supported by lifting tables 12 and 13.

A runway or track 14 with rails **14*a* and 14*b* passes through the stations 6 and 7 and into the press 1. Movable along the track 14 is a shuttle 15, which comprises three horizontal plates 16, 17, 18, which at their sides are connected to vertical beams or plates 19. The plates 16, 17, 18 and 19 define two superimposed, horizontial, open-ended transport compartments 23 and 24. Wheels 21, journalled on stub axles 22 mounted on the plates 19, run on the rails 14*a* and 14*b***.

Figure 1:
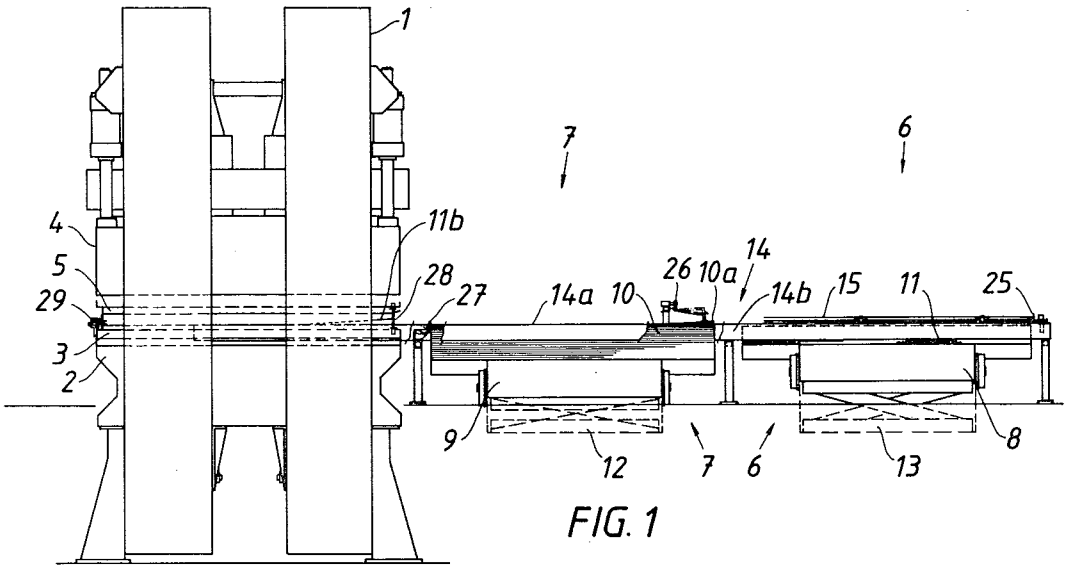
FIG. 1 is a schematic side view of a press provided with one embodiment of handling equipment in accordance with the invention.
Figure 3:
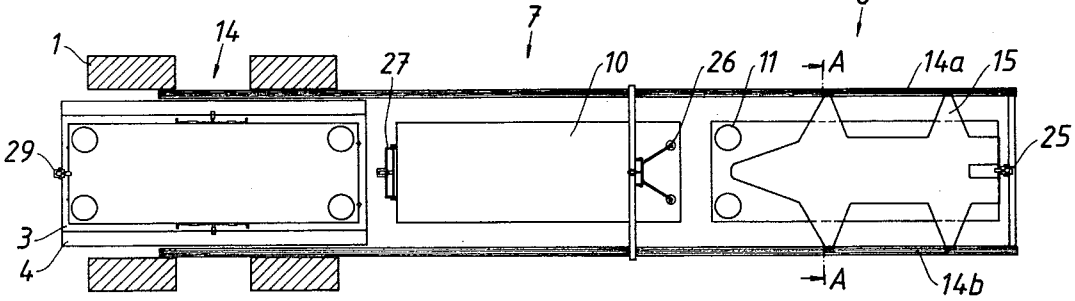
FIG. 3 is a partly sectioned plan corresponding to FIG. 1.
Figure 4:
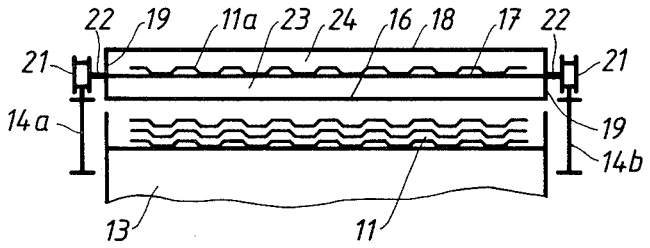
FIG. 4 is a sectional view, on an enlarged scale taken on the line A—A in FIG. 3.

At the right-hand end (as viewed in FIG. 1) of the first station 6 of the handling equipment there is a gripper 25 which is operable to grip a pressed product **11*a* in the compartment 24 of the shuttle 15. At the right-hand end (as viewed in FIG. 1) of the second station 7 there is a lifting device 26 which is operable to raise one end of the uppermost sheet blank 10*a* of a stack of sheet blanks 10 to the same level as the compartment 23 of the shuttle 15. At the left-hand end of the station 7 there is a stop member 27 intended to prevent displacement of the sheet 10*a* towards the press 1 when this sheet 10*a* is subjected to a force in a direction towards the press. At the right-hand end (as viewed in FIG. 1) of the press space in the press 1 there is a lifting device 28 for raising one end of a pressed product 11*b* to the same level as the compartment 24 of the shuttle 15. At the left-hand end of the press space there is a gripper 29, which is operable to grip a sheet blank 10***a* in the compartment 23 of the shuttle 15.

The mode of operation of the handling equipment will now be explained with reference to FIG. 5, which shows schematically the positions of various components of the press and the handling equipment at six different points of time during a working cycle of the press.

Figure 5:
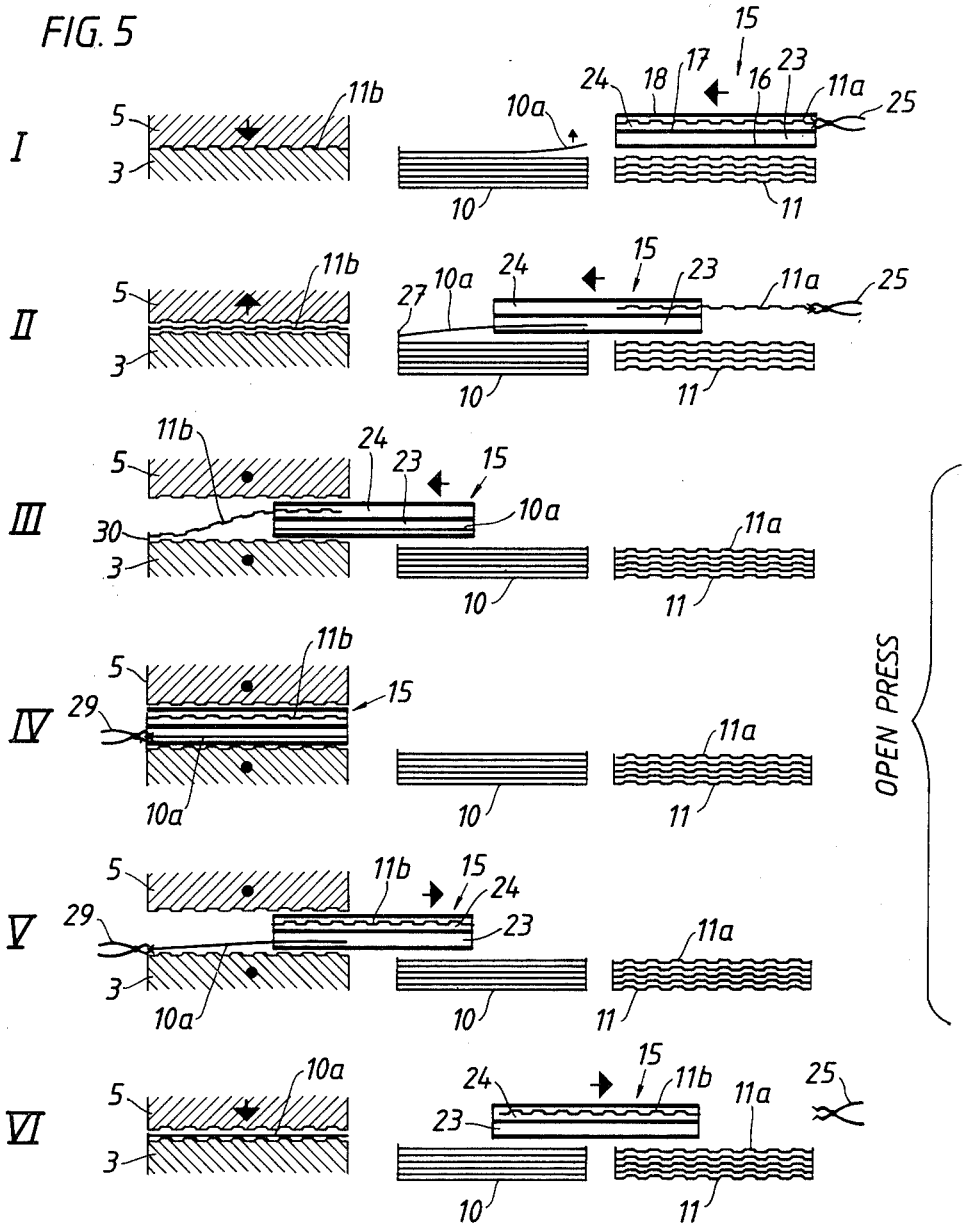
FIG. 5 is a series of diagrams showing schematically the mode of operation of handling equipment of FIGS. 1 to 4 in six different positions during a working cycle of the press.

FIG. 5:I shows the situation at the end of a pressing operation in which a pressed product 11*b* has just been produced. The shuttle 15 is in its right-hand end position over the station 6 with a pressed product 11*a* in its upper compartment 24. The product 11*a* has entered between, and been gripped by, the jaws of the gripper 25. The lifting device 26 at the station 7 has gripped a sheet blank 10*a* and raised the right-hand end thereof to the same level as the compartment 23 of the shuttle 15.

In the FIG. 5:II, the shuttle has moved somewhat to the left from its right-hand end position. The gripper 25, which holds the pressed product 11*a*, has withdrawn the latter partially from the compartment 24 of the shuttle 15. The right-hand end of the sheet blank 10*a* has entered the compartment 23 of the shuttle, since the stop member 27 prevents the sheet blank 10*a* from being displced to the left. The press 1 is beginning to open.

As the shuttle 15 moves further to the left, towards the position shown in FIG. 5:III, the pressed product 11*a* is withdrawn completely from the compartment 24 and falls down onto the car 8 at the station 6. At the same time the lifting device 28 lifts the right-hand end of the recently pressed product 11*b* to the same level as the compartment 24 of the shuttle.

In FIG. 5:III, the shuttle 15 has moved partially into the press 1. The right-hand end of the pressed product 11*b* has entered into the compartment 24. A stop 30 at the left-hand end of the press space of the press 1 prevents displacement of the product 11*b* to the left. The force that needs to be absorbed by the stop 30 is insignificant, being only the resistance to sliding of the product 11*b* against the plate 17 of the shuttle 15.

In FIG. 5:IV, the shuttle 15 has reached its left-hand end position and is situated inside the press 1. The pressed product 11*b* is wholly within the compartment 24. The left-hand end of the sheet blank 10*a* has slid in between, and been gripped by, the jaws of the gripper 29.

In FIG. 5:V, the shuttle 15 has moved to the right, from its position in FIG. 5:IV, on its way out of the press 1. Because the sheet blank 10*a* is retained by the gripper 29, it has been partially withdrawn from the compartment 23.

As the shuttle 15 moves further to the right, towards the position shown in FIG. 5:VI, the sheet blank 10*a* is completely withdrawn from the compartment 23 and falls down onto the lower press tool 3.

In FIG. 5:VI, the shuttle 15 has left the press 1 completely and is on its way towards its right-hand end position over the station 6. The upper press tool 5 is on its way down towards the lower press tool 3 for shaping the sheet blank 10*a*.

What is claimed is:

1. Handling equipment for a sheet press for feeding sheet blanks to the press and withdrawing pressed products from the press, said handling equipment comprising a first station for the reception of pressed products, a second station to contain a supply of sheet blanks, a track extending from the press to said stations, and a shuttle movable along said track and having substantially horizontal, first and second transport compartments at different levels, said first compartment serving to receive sheet blanks from said second station and deliver them to the press, and said second compartment serving to receive pressed products from the press and deliver them to said first station, a gripping device at said first station for retaining a pressed product upon the movement of said shuttle away from said first station, a lifting device adjacent one end of said second station for raising one end of a sheet blank to the same level as said first transport compartment of said shuttle, stop means for the sheet blank at the opposite end of said second station, a gripping device in the press for retaining a sheet blank, and a lifting device in the press for raising one end of a pressed product to the same level as said second transport compartment of said shuttle.

2. In a sheet press for pressing blanks into pressed products, the provision of handling equipment for feeding sheet blanks to the press and withdrawing pressed products from the press, said handling equipment comprising a first station remote from the press for the reception of said pressed products, a second station between said press and said first station for containing a supply of said sheet blanks, a track extending from said first station past said second station and into the press, and a shuttle reciprocatable along said track between a first end position at said first station and a second end position in said press, said shuttle comprising substantially horizontal, first and second open-ended transport compartments superimposed one on the other, said first compartment serving to receive said sheet blanks from said second station and deliver them to the press, and said second compartment serving to receive said pressed products from the press and deliver them to said first station.

3. A press according to claim 2, wherein said handling equipment further comprises a gripping device at said first station for retaining a pressed product upon the movement of said shuttle away from said first station, a lifting device adjacent one end of said second station for raising one end of a sheet blank to the same level as said first transport compartment of said shuttle, stop means for the sheet blank adjacent the opposite end of said second station, a gripping device in the press for retaining a sheet blank, and a lifting device in the press for raising one end of a pressed product to the same level as said second transport compartment of said shuttle.

* * * * *